US005640475A

United States Patent [19]

Takahashi

[11] Patent Number: 5,640,475

[45] Date of Patent: Jun. 17, 1997

[54] OPTICAL FIBER FERRULE HOLDING PLATE FOR OPTICAL FIBER END POLISHING APPARATUS

[75] Inventor: Mitsuo Takahashi, Matsudo, Japan

[73] Assignee: Seiko Giken Co., Ltd., Matsudo, Japan

[21] Appl. No.: 534,586

[22] Filed: Sep. 27, 1995

[30] Foreign Application Priority Data

Jan. 13, 1995 [JP] Japan ..... 7-021033

[51] Int. Cl.[6] ..... G02B 6/25

[52] U.S. Cl. ..... 385/85; 451/11; 451/271

[58] Field of Search ..... 451/285, 290, 451/271, 11; 385/85

[56] References Cited

U.S. PATENT DOCUMENTS

| | | | |
|---|---|---|---|
| 4,979,334 | 12/1990 | Takahashi | 451/271 |
| 5,216,846 | 6/1993 | Takahashi | 451/271 |
| 5,412,747 | 5/1995 | Matsuoka et al. | 385/85 |
| 5,461,689 | 10/1995 | Matsuoka et al. | 385/85 |
| 5,503,590 | 4/1996 | Saitoh et al. | 451/11 |

FOREIGN PATENT DOCUMENTS

| | | |
|---|---|---|
| 0579056 | 1/1994 | European Pat. Off. . |
| 2182272 | 5/1987 | United Kingdom . |

OTHER PUBLICATIONS

Patent Abstracts of Japan, vol. 4, No. 58 (P–009) Apr. 30, 1980, JP–A–55 028058 (Nippon Telegr & Teleph Corp–NTT) Feb. 28, 1980 "End Face Forming Device of Connector for Optical Fiberconnection".

*Primary Examiner*—Rodney B. Bovernick
*Assistant Examiner*—Ellen E. Kang
*Attorney, Agent, or Firm*—Spencer & Frank

[57] ABSTRACT

An optical fiber ferrule holding plate for an optical fiber end polishing apparatus for simultaneously polishing the end surfaces of a plurality of ferrules with optical fibers has an improved durability and workability. The optical fiber ferrule holding plate includes a ferrule outer periphery supporting member which is made of a hard burned ceramic member, and which includes, at the center thereof, an inserting hole for receiving the end outer periphery of the ferrule with an optical fiber and which receives and supports a plurality of ferrules with optical fibers. A holding plate main unit which has a plurality of through holes for receiving a plurality of ferrule outer periphery supporting members is provided, which receives, fixes, and supports the ferrules with optical fibers in the through holes. A device is provided for detachably holding the ends of the ferrules with optical fibers, which have been inserted in the members for supporting the outer peripheries of the ferrules with optical fibers, toward a polishing board.

7 Claims, 3 Drawing Sheets

OPTICAL FIBER FERRULE HOLDING PLATE FOR OPTICAL FIBER END POLISHING APPARATUS

BACKGROUND OF THE INVENTION

1. Field of the Invention

The present invention relates to an optical fiber ferrule holding plate for an optical fiber end polishing apparatus for simultaneously polishing the optical fiber end surfaces of a plurality of ferrules with optical fibers and, more particularly, to an optical fiber ferrule holding plate for an optical fiber end polishing apparatus which has an improved durability of the section of a polishing holder where the ferrules with the optical fibers are attached and detached and which also has an improved attaching and detaching workability.

2. Description of the Related Art

There have been proposed many optical fiber end surface polishing apparatuses for simultaneously polishing a plurality of optical fiber end surfaces. Takahashi, the inventor of the present invention, has many filed applications for optical fiber end surface polishing apparatuses and has acquired U.S. Pat. No. 4979334 ("Polishing apparatus for end faces of optical fibers") and U.S. Pat. No. 5216846 acquired on Jun. 8, 1993 ("Method and apparatus for grinding foremost end surface of a ferrule").

The aforesaid optical fiber end surface polishing apparatuses are configured to hold an optical fiber ferrule with a plurality of optical fibers thereto in an optical fiber ferrule holding plate, and cause relative movement based on a circular motion between a polishing board and the distal end of the optical fiber ferrule, thereby polishing the distal end of the optical fibers.

The inventor of the present invention has filed an application for "Optical fiber end polishing apparatus for polishing a plurality of types of optical fibers" (Japanese Patent Application No. 6-270529) on a polishing apparatus equipped with an improved optical fiber ferrule holding plate for holding a plurality of optical fiber ferrules with optical fibers attached thereto in order to accomplish a higher operation efficiency of the aforesaid polishing apparatuses.

FIG. 4 is a top view schematically showing the principle of the optical fiber ferrule holding plate which can be used for the optical fiber end polishing apparatus stated above. FIG. 5 is a front cross-sectional view showing a part of the optical fiber ferrule holding plate for the optical fiber end polishing apparatus illustrated in FIG. 4. A cylindrical hub 2 to be coupled to a holding shaft (not shown) is provided at the center of a holder plate main unit 1. A plurality of ferrule fixing sections 3 with optical fibers of the same type are provided on a concentric circle of the holder plate main unit 1.

FIG. 5 is a cross-sectional view taken along section V-V of FIG. 4 showing the details of the ferrule fixing section 3 with a single optical fiber attached. A plurality of FC type ferrules 5 with optical fibers 4 are fixed by the fixing sections 3. End surfaces 6 of the ferrules are pressed against a polishing board 11 at a right angle.

Fixing section 3 includes of a ferrule receiving cylindrical bushing mounting member 8 which includes a through hole 7 through its center. Ferrule 5 is inserted through hole 7. An external screw thread 8*a* is provided on the outer periphery of mounting number 8. A box nut 9 is provided with a slit 10, and has an internal thread which engages with the external thread 8*a* so as to tighten and fit the optical fiber and ferrule onto the cylindrical bushing mounting member 8.

Even with the optical fiber ferrule holding plate for the optical fiber end polishing apparatus stated above, in order to polish smaller ferrules, the fixing sections need to be installed densely on the disc, and the slitted box nut 9 and the like must accordingly be made smaller. This has led to a problem in that the box nut 9 or the like may be lost during work. Further installing or removing a single fixing section 3 having the screw thread takes 10 to 20 seconds.

Currently, most optical connector ferrules measure 2.5 mm in outside diameter and 8 mm in effective length. With the increasing trend toward smaller optical circuit systems, however, an optical connector ferrule which is as small as half the size of the aforementioned optical connector ferrule has been developed and is being put to practical use. In such a small optical connector ferrule, the screw-tightening structure is so small that it is difficult to handle. This prevents a ferrule with an optical fiber attached thereto from being fixed to the polishing holder by the conventional screw-tightening method.

Furthermore, the squareness or an error in the tilt angle of the end surface of a polished ferrule with an optical fiber with respect to a central axis seriously affects the connecting performance of the optical fiber connector. The angle of the end surface is known to depend on the gap between the through hole 7 in the mounting member 8 and the outer periphery of the ferrule. If the allowable angle error is taken as 0.2 degree, then the gap has to be designed and manufactured to satisfy one tenth thereof, namely, approximately 0.02 degree. Hence, when the ferrule supporting length of the through hole in the mounting member is 5 mm, the allowable gap is 2 μm in diameter.

Normally, stainless steel which is hardened to about 52 to 60 in Rockwell hardness is used for the material of the mounting member from the aspect of workability. It is practically impossible to completely avoid the adherence of hard diamond or green carborundum powder, which is used as the abrasive, in the gap. It is accordingly impossible to avoid the deterioration in the end surface polishing accuracy over time due to the wear from scratches on the wall surface of the through hole 7 in the fixing section.

SUMMARY OF THE INVENTION

It is an object of the present invention to provide an optical fiber ferrule holding plate for an optical fiber end polishing apparatus which is capable of achieving further improvement in durability and workability.

To this end, an optical fiber ferrule holding plate for an optical fiber end polishing apparatus for simultaneously polishing the end surfaces of a plurality of ferrules with optical fibers according to the present invention is constituted by a ferrule outer periphery supporting member which is made of a hard burned ceramic member provided, at the center thereof, with an inserting hole for receiving the end outer periphery of the ferrule with an optical fiber and which receives and supports a plurality of ferrules with optical fibers; a holding plate main unit which has a plurality of through holes for receiving a plurality of the ferrule outer periphery supporting members to fix and support the ferrule outer periphery supporting members; and means for detachably holding and directing the ends of the ferrules with optical fibers, which have been inserted in the members for supporting the outer peripheries of the ferrules with optical fibers, toward a polishing board.

The through holes for receiving the ferrule outer periphery supporting members can be provided at a right angle or at any angle with respect to a polishing surface.

The holding means can be rotated around a shaft provided on the polishing holder plate surface and it may be comprised of a holding plate which is urged downward by a spring.

The through holes for receiving the ferrule outer periphery supporting members can be provided in a ferrule outer periphery supporting member mounting plate which is fixed integrally at an arbitrary angle with respect to the optical fiber ferrule holding plate for an optical fiber end polishing apparatus.

The ferrule outer periphery supporting member mounting plate can be provided with a threaded section for the means for detachably holding the end of a ferrule with an optical fiber toward a polishing board.

Preferably, the hardness of the hard ceramic burned member constituting the ferrule outer periphery supporting member is 1000 or more in Vickers hardness.

DESCRIPTION OF THE PREFERRED EMBODIMENTS

The present invention will be described in further detail with reference primarily to the accompanying drawings.

Figure 1:
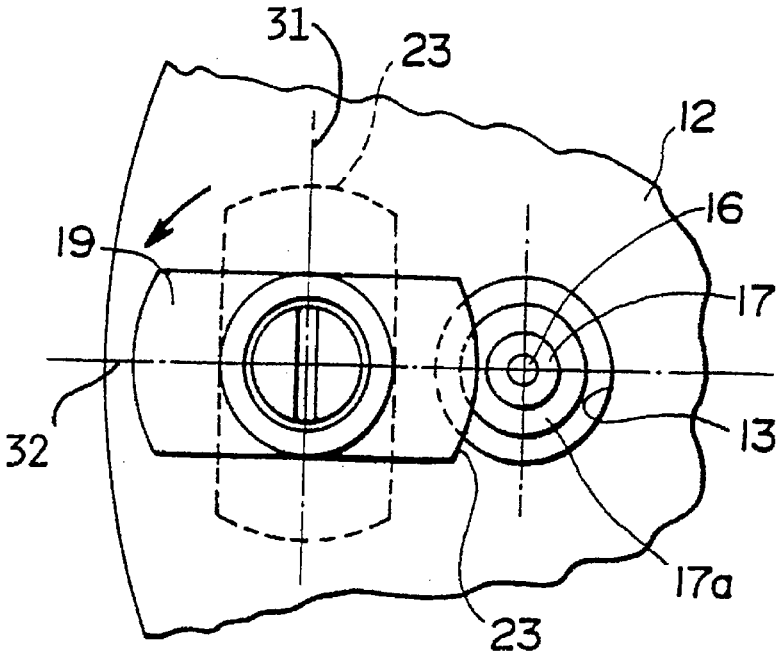
FIG. 1 is a top view showing a part of an embodiment of an optical fiber ferrule holding plate for an optical fiber end polishing apparatus in accordance with the present invention.
Figure 2:
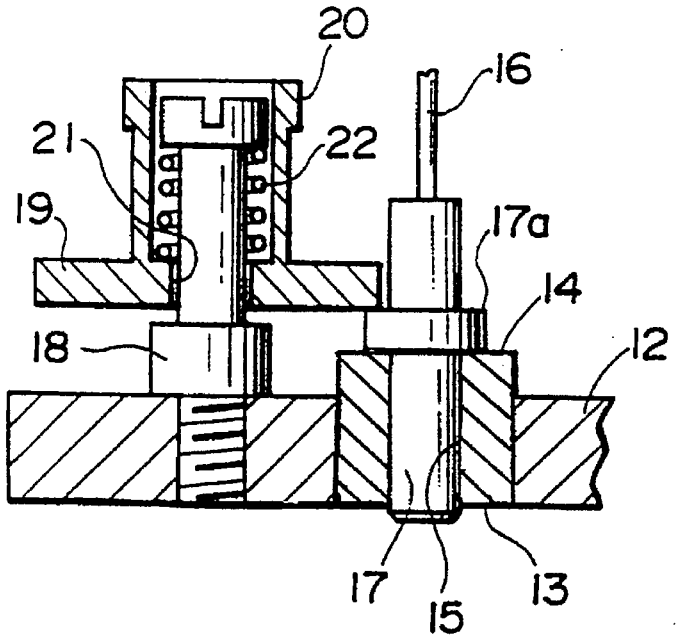
FIG. 2 is a front cross-sectional view of the section of the embodiment mentioned above.

FIG. 1 is a top view showing a section of a first embodiment of the optical fiber ferrule holding plate for an optical fiber end polishing apparatus in accordance with the present invention. FIG. 2 is a front cross-sectional view of the section of the embodiment mentioned above.

A holder plate main unit 12 made of a thin plate is provided with a plurality of through holes 13 for receiving ferrule receiving (supporting) members 14 on a concentric circle. Provided at the center of the ferrule receiving member 14 is a ferrule inserting hole 15. The ferrule receiving member 14, which is made of a burned zirconia ceramic material with Vickers hardness of 1800, is press-fitted in or fixed with an adhesive to the through hole 13 of the holder plate main unit 12.

A ferrule 17 with an optical fiber 16 is inserted in the aforesaid through hole.

A fixed shaft 18 is mounted perpendicularly to the holder plate main unit 12, with a screw, adjacently to the ferrule receiving member 14. A ferrule holding plate 19 has a hole 21, through which the fixed shaft 18 is inserted, at the center thereof and a cylindrical rotary knob 20 on the head thereof. The ferrule holding plate 19 can be horizontally turned around the fixed shaft 18 using the cylindrical rotary knob 20. A compression coil spring 22 is provided between the rotary knob 20 and the fixed shaft 18.

To fix the ferrule 17 with an optical fiber attached, the rotary knob 20 is lifted and the holding plate 19 is placed as shown in the broken line indicated by line 31 in FIG. 1. With the holding plate 19 set in this position, the ferrule 17 with an optical fiber 16 is inserted in the hole 15. Then, the rotary knob 20 is lifted up again, and the holding plate 19 is turned until it reaches position 32, where an outer edge section 23 of the holding plate 19 is flush with the top surface of a flange 17*a* of the ferrule 17. This causes the bottom surface of the outer edge section 23 of the holding plate 19, which is pressed downward by the compression spring 22, to uniformly clamp and fix each ferrule 17 independently onto the holder plate main unit 12.

Figure 3:
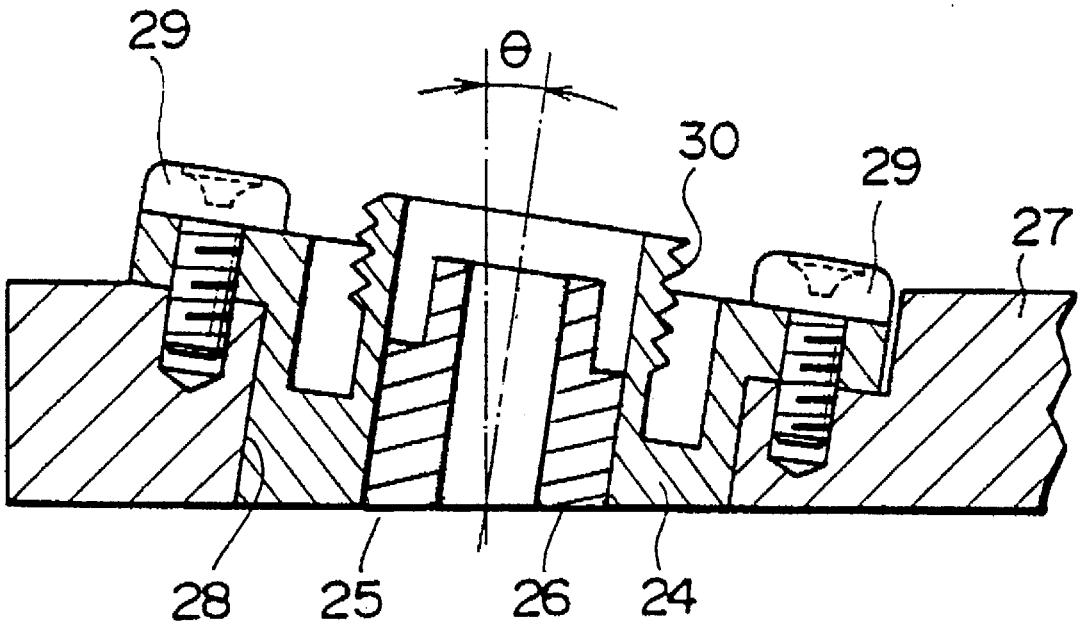
FIG. 3 is a front cross-sectional view showing a part of another embodiment of the optical fiber ferrule holding plate for an optical fiber end polishing apparatus in accordance with the present invention.
Figure 4:
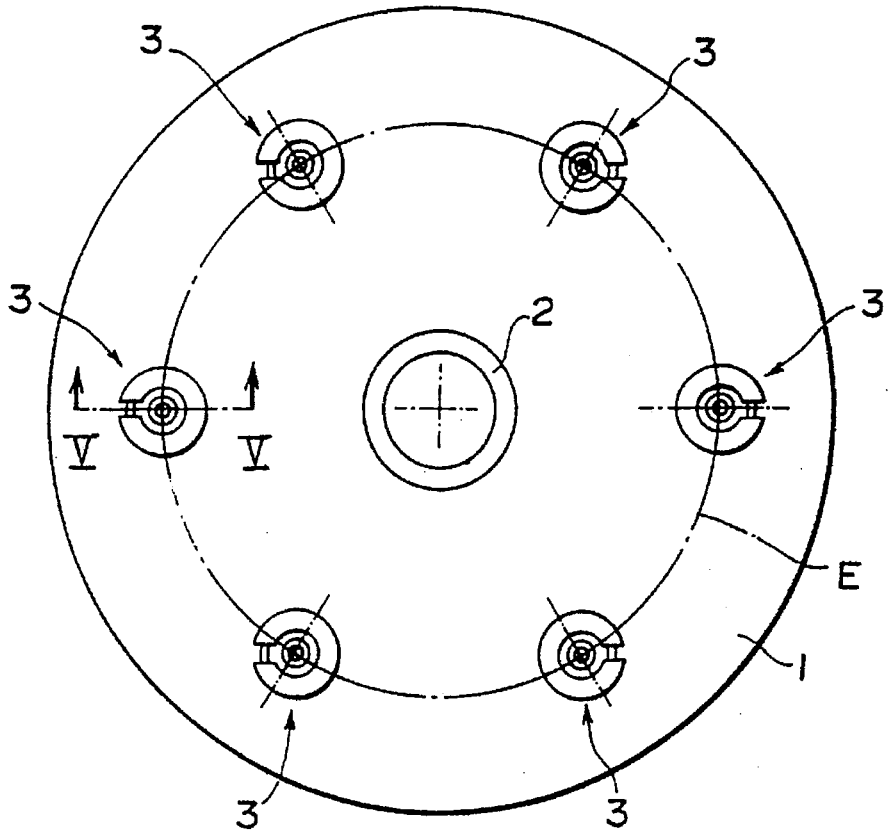
FIG. 4 PRIOR ART
FIG. 4 is a top view showing an optical fiber ferrule holding plate for an optical fiber end polishing apparatus in accordance with a previous application filed by the inventor.
Figure 5:
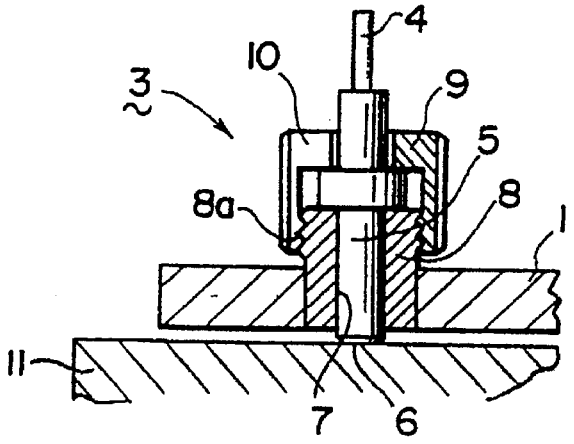
FIG. 5 PRIOR ART
FIG. 5 is a front cross-sectional view showing a part of the optical fiber ferrule holding plate for an optical fiber end polishing apparatus illustrated in FIG. 4.

FIG. 3 is the front cross-sectional view showing a section of another embodiment of the optical fiber ferrule holding plate for an optical fiber end polishing apparatus in accordance with the present invention.

In this embodiment, a through hole 25 for receiving and supporting a cylindrical ferrule outer periphery supporting member 26 is provided in a ferrule outer periphery supporting member mounting plate 24. The ferrule outer periphery supporting member mounting plate 24 is made of stainless steel which is hardened to about 52 to about 60 in Rockwell hardness. The cylindrical supporting member 26 is made of a burned zirconia ceramic material having Vickers hardness of 1800, and is press-fitted in the central hole 25 and fixed by adhesion in advance. The ferrule outer periphery supporting member mounting plate 24 is fixed, with screws 29, in a hole 28 provided in the holding plate main unit 27. The installing angle of the ferrule outer periphery supporting member mounting plate 24 with respect to the holder plate main unit 27 is determined by machining.

Thus, this embodiment is suitably used for polishing a screw-tightened JIS FO1 type optical connector by tilting it by an angle θ. An external thread screw 30 is provided on the ferrule outer periphery supporting member mounting plate 24, and engages with a coupling nut (not shown) of the optical connector. This screw thread and the coupling nut of the optical connector together constitute the holding means in this embodiment, so that the main unit does not need any other holding means.

As described above in detail, the holding plate for polishing the end surfaces of a ferrule with an optical fiber in accordance with the present invention uses a hard burned ceramic member (e.g. burned zirconia ceramic material having Vickers hardness of 1000 or more) for the mounting member for the ferrule with the optical fiber. This makes the wall surface of the through hole less prone to wear from scratches caused by the adhesion of abrasive powder even after a great number of polishing cycles are performed over an extended period of time, thus enabling stable polishing quality for the end surfaces of optical fibers to be maintained.

Moreover, turning the spring-loaded holding plate permits easy fixing of the ferrule to the polishing holder. This method is ideally used for mounting and fixing an extremely small ferrule with an optical fiber.

The coupling nut of the optical connector shown in the second embodiment is provided for each optical connector and it is difficult to lose. Hence, it is extremely reasonable to use such a coupling nut.

What is claimed is:

1. An apparatus for simultaneously polishing, using a polishing board, the end surfaces of a plurality of ferrules each retaining an optical fiber, comprising:

a holder plate having a plurality of through holes;

a plurality of supporting members, each being fixed and secured in a respective through hole and supported by said holder plate, each supporting member being comprised of a hard burned ceramic material and having a through hole at a center thereof for receiving an end of a respective ferrule so as to support the ferrule at an outer periphery thereof; and means for detachably holding the ferrules within the respective supporting members, and for directing the ends of the respective ferrules toward the polishing board.

2. The apparatus defined in claim 1, wherein the through holes within said holder plate are arranged at a right angle relative to a surface of the polishing board.

3. The apparatus defined in claim 1, wherein the through holes within said holder plate are arranged at an arbitrary angle relative to a surface of the polishing board.

4. The apparatus defined in claim 1, wherein said means for detachably holding the ferrules comprises a shaft connected to said holder plate, a ferrule holding plate rotatably mounted to said shaft, and a spring urging said ferrule holding plate in a direction toward the polishing board.

5. The apparatus defined in claim 1, further comprising a plurality of mounting plates integrally fixed to said holder plate at an arbitrary angle, each being located within a respective through hole of said holder plate, and each having a through hole for receiving a respective supporting member.

6. The apparatus defined in claim 5, wherein each of said mounting plates includes a threaded section for receiving a respective nut, and wherein said means comprises said threaded section.

7. The apparatus defined in claim 1, wherein the hard burned ceramic material has a Vickers hardness of at least 1000.

* * * * *